United States Patent [19]

Heckrotte, Sr.

[11] 4,364,287

[45] Dec. 21, 1982

[54] METHOD FOR MAKING A KEY FOR DRIVING TAMPER-PROOF BOLT

[75] Inventor: John R. Heckrotte, Sr., Phoenix, Ariz.

[73] Assignee: Cactus Technology Corp., Phoenix, Ariz.

[21] Appl. No.: 253,696

[22] Filed: Apr. 13, 1981

Related U.S. Application Data

[62] Division of Ser. No. 101,821, Dec. 10, 1979, Pat. No. 4,291,599.

[51] Int. Cl.[3] ..... B21K 5/00

[52] U.S. Cl. ..... 76/101 D

[58] Field of Search ..... 76/101 D, 101 R; 81/444, 445, 442, 443; 403/326, 378, 328, 379, 322, 8; 29/280, 253

[56] References Cited

U.S. PATENT DOCUMENTS

| | | | |
|---|---|---|---|
| 2,506,922 | 5/1950 | Hansen | 81/444 |
| 3,172,282 | 3/1965 | Heckrotte | 81/444 |
| 3,549,182 | 12/1970 | Boque | 403/378 |

*Primary Examiner*—Roscoe V. Parker

*Attorney, Agent, or Firm*—Cahill, Sutton & Thomas

[57] ABSTRACT

An improved key for driving tamper-proof bolts includes a plastic key handle molded onto one end of a tubular sleeve. The tubular sleeve has a transverse aperture near an end opposite the key handle, and a ball is captively held by the tubular sleeve adjacent the transverse aperture. Molded into the key handle are a chamber providing access to one end of the tubular sleeve and a channel extending transversely through the chamber. The key also includes a plastic plunger handle molded onto an end of a plunger rod axially slidable within the tubular sleeve. A camming surface is located on the end of the plunger rod opposite the plunger handle for camming the ball into the transverse aperture of the tubular sleeve. Molded into the plunger handle is a flattened surface and a flange. A pin is press-fit into the channel adjacent and parallel to the flattened surface of the plunger handle for preventing the plunger handle from rotating and for retaining the flange within the chamber of the key handle.

4 Claims, 6 Drawing Figures

METHOD FOR MAKING A KEY FOR DRIVING TAMPER-PROOF BOLT

This is a division of application, Ser. No. 101,821, filed Dec. 10, 1979, now U.S. Pat. No. 4,291,599.

BACKGROUND OF THE INVENTION

1. Field of the Invention

The present invention relates generally to keys for driving tamper-proof bolts, and more particularly, to an improved key for driving tamper-proof bolts and a method for making the same.

2. Description of the Prior Art

Tamper-proof threaded bolts or locking devices are well known in the art for protecting various devices from unauthorized access or tampering. For example, in U.S. Pat. No. 3,172,282 entitled "Anti-Tampering Cut-Off Valve Cover" and issued to the inventor of the present invention, a tamper-proof housing is disclosed which is particularly adapted to protect a cut-off valve of the type commonly interposed in water and gas service lines. Threaded locking elements or bolts having a hollow head including a transverse notch or aperture through a sidewall of the head are used to fasten together a pair of mating clamp elements which form a tamper-proof housing enclosing the cut-off valve. Also in U.S. Pat. No. 3,743,239, a lock-off valve is disclosed which includes a locking element having an enlarged head and a threaded shank portion which is arranged in a threaded bore of the valve housing. Similarly, U.S. Pat. No. 3,861,180 discloses an electric meter lock ring of the type commercially available from Morlock, Inc., Phoenix, Ariz. The electric meter lock ring includes a locking element with an enlarged head having a cavity and an aperture in the enlarged head communicating with the cavity. Other locking mechanisms, such as bolt locks employing similar locking elements, are also commercially available, for example those supplied by Morlock, Inc., Phoenix, Ariz.

For each of the locking mechanisms mentioned above, a specially designed key unit is used to rotate the locking element or threaded bolt in order to provide access to the protected device. The key is generally described in U.S. Pat. No. 3,172,282 and includes a plunger rod axially slidable within a tubular sleeve, the tubular sleeve having a transverse aperture at one end thereof. A ball is captively held by the tubular sleeve adjacent the transverse aperture. The plunger rod includes a camming surface at one end thereof for camming the ball into the transverse aperture in the tubular sleeve.

In actual operation, the key is inserted into the hollow head of the threaded bolt, and the key is rotated until the transverse aperture in the tubular sleeve is aligned with the transverse notch or aperture in the sidewall of the hollow head. The plunger rod is pushed against the ball and cams it into the transverse aperture in the tubular sleeve and into the notch or aperture in the hollow head of the threaded bolt. In this manner, a positive rotatable driving connection is established between the key and the threaded bolt. Upon rotation of the key, the threaded bolt may be inserted into or withdrawn from a threaded recess for locking or unlocking, respectively, the protected device.

Although the key described above is well suited for driving threaded bolts of the type mentioned above, construction of the key presently requires many steps which consume much time and labor, thereby resulting in significant expense. The steps presently employed to construct such a key include the following:

1. an outer sleeve or key handle is molded having a cylindrical channel through its longitudinal axis, the diameter of the cylindrical channel being slightly smaller than the diameter of the tubular sleeve;
2. the tubular sleeve is machine-pressed into the cylindrical channel of the outer sleeve or key handle;
3. a hole is drilled transversely into the key handle from its outer surface and extending into the tubular sleeve, the hole extending perpendicular to the longitudinal axes of the tubular sleeve and key handle;
4. threads are tapped in the hole drilled in the key handle and tubular sleeve; these threads later engage the threads of a set screw;
5. a flat is machined onto a portion of the plunger rod; the flat, in conjunction with the set screw, prevents the plunger rod from rotating within the tubular sleeve; the flat and set screw also allow the plunger rod to slide axially within the tubular sleeve while preventing the plunger rod from being withdrawn from the tubular sleeve;
6. a rolled metal sleeve or retaining collar is pressed onto one end of the plunger rod opposite the camming surface;
7. the rolled metal sleeve end of the plunger rod is machine pressed into a hole within a metal plunger handle;
8. the plunger rod is inserted into the tubular sleeve and positioned so that the machined flat is aligned with the hole in the tubular sleeve and the threaded hole in the key handle;
9. a set screw is screwed into the threaded hole in the key handle and advanced through the hole in the tubular sleeve until the set screw abuts the machined flat on the plunger rod;
10. an epoxy seal is applied to the threaded hole in the key handle over the set screw to prevent the set screw from being worked loose, whereby the various parts of the key can be integrally maintained.

In view of the steps set forth above, it should be appreciated that such a key can be constructed according to presently known methods only at considerable cost.

Accordingly, it is an object of the present invention to provide an improved key for driving tamper-proof bolts wherein the key may be constructed with far fewer steps than in the prior art, thereby saving considerable amounts of time, labor and expense.

It is another object of the present invention to provide a method of constructing a key for driving tamper-proof bolts, the method requiring far fewer steps than the method used in the prior art, thereby saving considerable amounts of time, labor and expense.

SUMMARY OF THE INVENTION

Briefly described, and in accordance with one embodiment thereof, the present invention relates to an improved key for driving tamper-proof bolts, the key including a key handle molded onto one end of a tubular sleeve and a plunger handle molded onto one end of a plunger rod. At the end of the plunger rod opposite the plunger handle is a camming surface for camming a ball through an aperture in the tubular sleeve. The key handle has a chamber molded therein to provide access to the end of the tubular sleeve. The plunger handle is axially slidable within the chamber of the key handle for axially sliding the plunger rod within the tubular sleeve. Molded upon the plunger handle is a flattened surface parallel to the longitudinal axis of the plunger rod. Also molded upon the plunger handle is a flange adjacent an edge of the flattened surface closest to the camming surface of the plunger rod, the flange projecting away from the plunger rod beyond the flattened surface. A metal pin or other suitable retainer is inserted into the key handle passing through the chamber parallel to and adjacent the flattened surface of the plunger handle. The metal pin or retainer prevents the plunger handle from rotating within the chamber of the key handle. The metal pin or retainer also allows the plunger handle to axially slide within the chamber of the key handle but interferes with the flange of the plunger handle for preventing the plunger handle from being totally withdrawn from the chamber of the key handle. The present invention also relates to a method for constructing the improved key.

DETAILED DESCRIPTION OF THE PREFERRED EMBODIMENT

Figure 1:
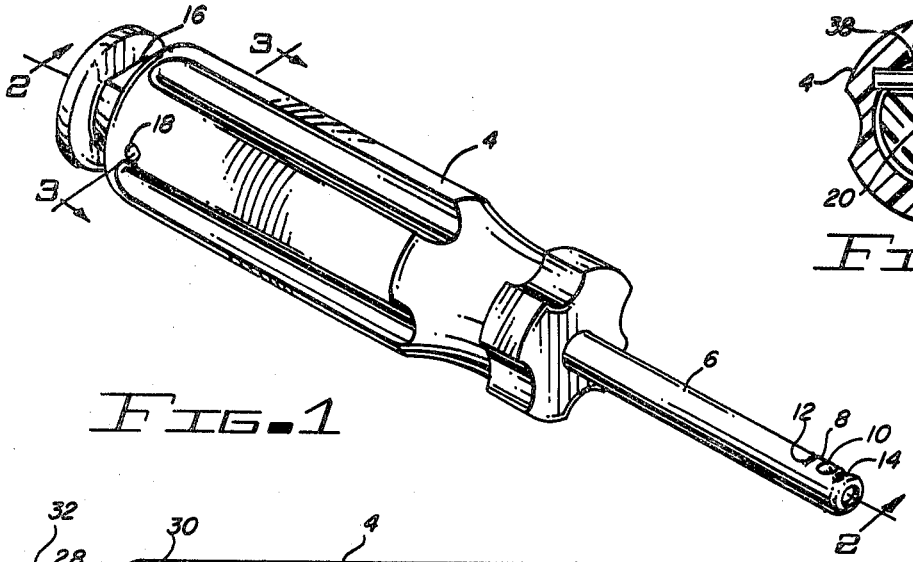
FIG. 1 is a perspective view of an improved key.

Shown in FIG. 1 is an improved key for driving tamper-proof bolts, the key including a plastic key handle 4 molded onto a tubular sleeve 6. At the end of tubular sleeve 6 opposite key handle 4 is a transverse aperture 8, and a ball 10 is shown partially protruding from aperture 8. Ball 10 is captively held by tubular sleeve 6 adjacent aperture 8. The diameter of ball 10 is slightly larger than the diameter of aperture 8 to prevent ball 10 from falling out of tubular sleeve 6 through aperture 8. Indentations have been punched into tubular sleeve 6 at points designated 12 and 14 on either side of aperture 8 to maintain ball 10 adjacent aperture 8. Indentations 12 and 14 are more clearly illustrated in FIG. 2A.

Also shown in FIG. 1 at one end of key handle 4 is plunger handle 16 to be further described below. At the point designated 18 in FIG. 1, a channel extends into key handle 4 as shown in greater detail in FIG. 3.

Figure 2A:
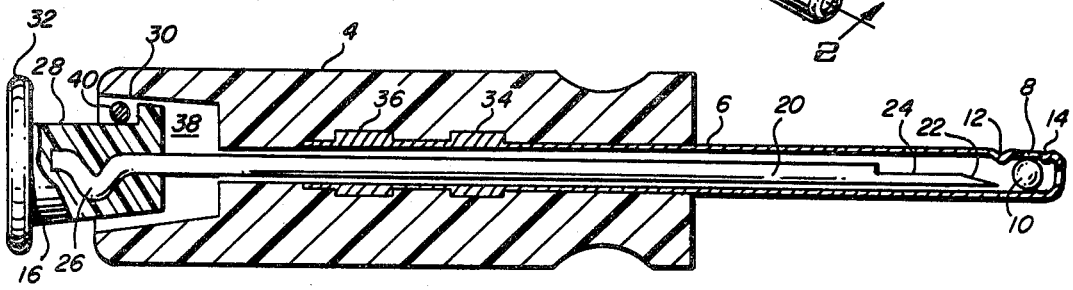
FIGS. 2A and 2B are cross-sectional views of the improved key taken along lines 2—2 shown in FIG. 1.
Figure 2B:
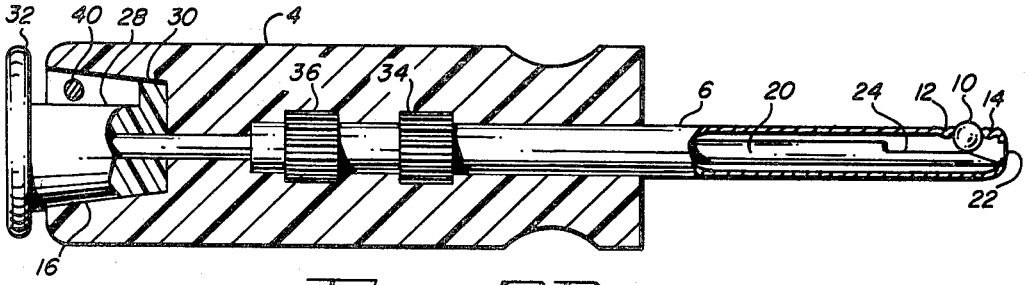

Referring to FIGS. 2A and 2B, elements which correspond to those already described with reference to FIG. 1 are identified with identical reference numerals. In FIGS. 2A and 2B, it will be seen that a plunger rod 20 extends within tubular sleeve 6. Plunger rod 20 has at one end thereof a camming surface including an inclined portion 22 and a flat portion 24. Plunger rod 20 slides within tubular sleeve 6 along its longitudinal axis for camming ball 10 into aperture 8.

In FIG. 2A, the camming surface of plunger rod 20 is shown pulled away from ball 10, and ball 10 is completely contained within tubular sleeve 6. As plunger rod 20 slides toward aperture 8, ball 10 rides up along inclined surface 22 and protrudes through aperture 8. FIG. 2B illustrates plunger rod 20 in its fully advanced position wherein ball 10 is cammed into aperture 8 by flat portion 24 of the camming surface. Similarly, when plunger rod 20 is withdrawn, ball 10 rides down inclined portion 22 of the camming surface until ball 10 is once again completely contained within tubular sleeve 6.

Figure 4:
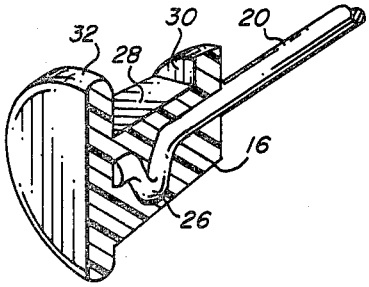
FIG. 4 is a perspective view shown in cross-section of the plunger handle and a portion of the plunger rod.

Referring to FIG. 2A, FIG. 2B and FIG. 4, plunger handle 16 is typically composed of plastic and is molded onto the end of plunger rod 20 opposite the camming surface end. A bend in plunger rod 20 designated at point 26 prevents plunger rod 20 from slipping within plunger handle 16.

Molded upon plunger handle 16 is a flat surface 28 which is parallel to the longitudinal axis of plunger rod 20. Also molded upon plunger handle 16 is a flange 30 adjacent the edge of flattened surface 28 nearest the camming surface of the plunger rod. As shown in the figures, flange 30 extends away from plunger rod 20 above and beyond flattened surface 28. Also molded onto plunger handle 16 is a lipped portion 32 which may be conveniently grasped for advancing or withdrawing plunger rod 20.

Figure 5:
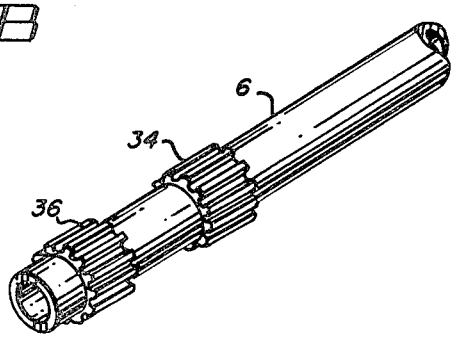
FIG. 5 is a perspective view of a portion of a tubular sleeve.

Referring now to FIG. 2A, FIG. 2B and FIG. 5, it will be noted that the end of tubular sleeve 6 upon which key handle 4 is molded includes knurled portions 34 and 36 on its outer surface. Knurled portions 34 and 36 prevent tubular sleeve 6 from slipping within key handle 4.

Figure 3:
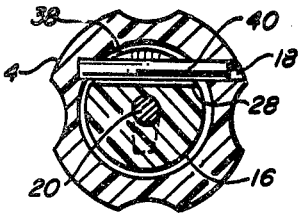
FIG. 3 is a cross-sectional view of the improved key taken along lines 3—3 shown in FIG. 1.

Referring now to FIG. 2A, FIG. 2B and FIG. 3, it will be noted that a chamber 38 is molded within an end of key handle 4. Chamber 38 provides access to the end of tubular sleeve 6 over which key handle 4 is molded for allowing the camming surface end of plunger rod 20 to be inserted into tubular sleeve 6. Chamber 38 is also configured to permit plunger 16 to be axially slidable within chamber 38 for either advancing camming surfaces 22 and 24 toward ball 10 or withdrawing camming surfaces 22 and 24 away from ball 10.

In order to maintain camming surfaces 22 and 24 in alignment with aperture 8, plunger rod 20 must be prevented from rotating within tubular sleeve 6. It is also desirable to prevent plunger rod 20 from being completely withdrawn from tubular sleeve 6 after the key has been assembled in order to maintain the key as an integral unit. For these reasons, a metal retaining pin 40 is inserted into key handle 4 during assembly of the key and after plunger 16 has been inserted within chamber 38 of key handle 4. Pin 40 extends transversely through chamber 38 parallel and adjacent to flattened surface 28 of plunger 16. Typically, pin 40 is press-fit or machine-pressed into a channel 18 which is molded into key handle 4. Pin 40 is inserted into channel 18 with sufficient force to prevent pin 40 from later working loose.

As is best shown in FIGS. 2A and 2B, the flattened surface 28 of plunger 16 can slide across pin 40 for a distance which is sufficient to permit the camming surfaces 22 and 24 of plunger rod 20 to engage or release ball 10. However, pin 40 is positioned to interfere with flange 30 when plunger 16 is withdrawn, thereby preventing plunger rod 20 from being completely withdrawn from tubular sleeve 6. Also, pin 40 prevents plunger handle 16 from rotating within chamber 38 of key handle 4 as is best shown in FIG. 3.

The method of constructing the improved key according to the present invention can be summarized as six simple steps set forth below:

1. knurls are formed on the tubular sleeve 6 at the end opposite aperture 8;

2. plastic key handle 4 is molded onto tubular sleeve 6;
3. a bend is formed in plunger rod 20 at the end opposite the camming surface;
4. plastic plunger handle 16 is molded onto plunger rod 20;
5. plunger rod 20 is inserted into tubular sleeve 6; and
6. metal pin 40 is machine-pressed into channel 18 within key handle 4.

In contrast, the prior art method of constructing the key set forth in the Description of the Prior Art above included ten steps of greater complexity than the six simple steps set forth above.

It will now be appreciated that an improved key for driving tamper-proof bolts has been described which greatly simplifies construction of the key, thereby significantly reducing the amounts of time, labor and expense associated with the manufacture of such keys. A method for making such an improved key has also been described. While the invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

I claim:

1. A method of constructing a key for driving tamper-proof bolts, the key including a tubular sleeve having a transverse aperture at a first end thereof and an outer surface, a plunger rod axially slidable within said tubular sleeve, said plunger rod having a camming surface at a first end thereof and having a longitudinal axis, and ball means captively held by said tubular sleeve adjacent the transverse aperture, said ball means being cammed into the aperture in said tubular sleeve by the camming surface upon axial movement of said plunger rod, said method comprising the steps of:

a. molding a plunger handle onto a second end of said plunger rod opposite the first end, said plunger handle molding step including the steps of providing a flattened surface parallel to the longitudinal axis of said plunger rod and providing a flange adjacent an edge of the flattened surface nearest the first end of said plunger rod, the flange projecting away from said plunger rod beyond the flattened surface;
b. molding a key handle onto a second end of said tubular sleeve opposite the first end, said key handle molding step including the step of forming a chamber within said key handle for providing access to the second end of said tubular sleeve;
c. inserting the first end of said plunger rod through the chamber of said key handle and into the second end of said tubular sleeve until the flattened surface of said plunger handle has entered the chamber in said key handle; and
d. inserting a pin transversely through the chamber of said key handle parallel with and adjacent to the flattened surface of said plunger handle for preventing said plunger handle from rotating within the chamber of said key handle and for retaining the flange of said plunger handle within the chamber of said key handle.

2. A method as recited in claim 1 further including the step of forming knurls on the outer surface of said tubular sleeve adjacent the second end of said tubular sleeve prior to said key handle molding step for preventing said tubular sleeve from slipping within said key handle.

3. A method as recited in claim 1 further including the step of bending the second end of said plunger rod prior to said plunger handle molding step for preventing said plunger rod from slipping within said plunger handle.

4. A method as recited in claim 1 wherein said key handle molding step includes the step of providing a channel extending transversely through the chamber of said key handle and extending through an opening in the outer surface of said key handle, the channel extending parallel with and adjacent to the flattened surface of said plunger handle, and wherein said step of inserting said pin through the chamber of said key handle comprises machine-pressing said pin into the channel through the opening in the outer surface of said key handle.

* * * * *

UNITED STATES PATENT AND TRADEMARK OFFICE

CERTIFICATE OF CORRECTION

PATENT NO. : 4,364,287
DATED : December 21, 1982
INVENTOR(S) : Heckrotte, Sr.

It is certified that error appears in the above-identified patent and that said Letters Patent are hereby corrected as shown below:

On the cover page of the patent, below the identification of the inventor, and following "[73] Assignee:", delete "Cactus Technology Corp.", and substitute --Morlock, Inc.--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*